US007404748B2

(12) United States Patent
Steigert et al.

(10) Patent No.: US 7,404,748 B2
(45) Date of Patent: Jul. 29, 2008

(54) EXHAUST SYSTEM

(75) Inventors: Andreas Steigert, Lambrecht (DE); Joerg Tillmann, St. Martin (DE); Thomas Weidner, Edenkoben (DE)

(73) Assignee: Heinrich Gillet GmbH, Edenkoben (DE)

( * ) Notice: Subject to any disclaimer, the term of this patent is extended or adjusted under 35 U.S.C. 154(b) by 0 days.

(21) Appl. No.: 11/403,963

(22) Filed: Apr. 14, 2006

(65) Prior Publication Data

US 2006/0230747 A1 Oct. 19, 2006

(30) Foreign Application Priority Data

Apr. 16, 2005 (DE) ..... 20 2005 006046 U

(51) Int. Cl.
*B63H 21/00* (2006.01)

(52) U.S. Cl. ..... 440/89 R

(58) Field of Classification Search ..... 440/89 R
See application file for complete search history.

(56) References Cited

U.S. PATENT DOCUMENTS 4,559,017 A * 12/1985 Cavil et al. ..... 440/76
6,537,116 B2 * 3/2003 Nakata et al. ..... 440/88 G
7,064,459 B1 * 6/2006 Staerzl ..... 307/95

FOREIGN PATENT DOCUMENTS

ES 2 073 969 8/1992

* cited by examiner

*Primary Examiner*—Jesús D Sotelo
(74) *Attorney, Agent, or Firm*—Muncy, Geissler, Olds & Lowe, PLLC

(57) ABSTRACT

An exhaust system is disclosed that has pipes and a housing, through which exhaust fumes of an internal combustion engine flow. The exhaust fumes generate a condensate, at least in part and/or in certain areas. To prevent the corrosion of sheet metal by the condensate, a sacrificial anode, which can be made of zinc and/or magnesium, is provided at least in one of the areas where the condensate collects.

9 Claims, 1 Drawing Sheet

EXHAUST SYSTEM

This nonprovisional application claims priority under 35 U.S.C. § 119(a) on German Patent Application No. DE 202005006046, which was filed in Germany on Apr. 16, 2005, and which is herein incorporated by reference.

BACKGROUND OF THE INVENTION

1. Field of the Invention

The present invention relates to exhaust systems.

2. Description of the Background Art

Exhaust fumes generated during the combustion of gasoline or diesel flow through exhaust systems of internal combustion engines. They contain carbon monoxide, carbon dioxide, nitrogen oxides, sulfur oxides, ammonium compounds and water vapor, to name a few. If the exhaust fumes drop below the dew point, particularly in the start and partial load range, a liquid condensate forms inside the exhaust system, with a pH-value of between 6.5 and 2.5. This condensate causes corrosion of the steel material that the exhaust system is made of.

Year after year, the automobile manufacturers demand a higher product life of the exhaust system. The objective is lifetime serviceability. Thus, the manufacturers of exhaust systems are forced to switch to stainless steels instead of surface-passivated steels, for example, aluminated steel. However, even stainless steel is subject to corrosion resulting from the combined effects of acid and heat. For this reason, the sheet metal for the manufacture of the pipes and housings must be of a considerable thickness. This makes it harder to work with, and increases both the weight and the cost.

It is known from container-building as well as shipbuilding to protect steel parts from corrosion by using sacrificial anodes, which essentially contain zinc and/or magnesium. A typical example are storage tanks of hot-water systems, whereby the storage tanks are completely filled with water so that the zinc or magnesium ions released by the sacrificial anodes can reach every part of the tank. In the corrosion protection of the body of a ship, seawater makes it possible for the ions to migrate to all parts of the ship's hull that are subject to corrosion.

It is suggested in ES 2073969 A to protect the entire chassis of a motor vehicle against corrosion with a sacrificial anode. The anode corrosion protection is to include all the components of the exhaust system that are connected to the chassis. This would protect the exhaust system from external corrosive attacks, for example, melted road salt, but not, however, from the internal corrosive attack by the condensate.

In actuality, the use of sacrificial anodes in the construction of automobiles did not prevail. Instead, the chassis is made of galvanized sheet metal.

Exhaust systems, on the other hand, are not made of galvanized sheet metal because using galvanized sheet metal to make exhaust pipes and housings is extremely problematic. As previously mentioned, stainless steels with a high content of chromium and nickel are used instead, or else ordinary steels coated with an aluminum alloy. When exposed to air, the aluminum coatings form an oxide layer, which effectively wards off corrosion attacks. However, as soon as the aluminum coating is damaged in one place, for example, when the steel is bent, punched, molded, or welded, the corrosion continues to advance unimpededly.

SUMMARY OF THE INVENTION

It is therefore an object of the present invention to provide, with minimal material and construction expenditures, an exhaust system that offers optimal and practically unlimited corrosion protection.

The present invention provides a sacrificial anode to the interior of the exhaust system, to wherever the condensate collects. In this way, the effect of the sacrificial anode is concentrated on the very surface areas that are reached by the condensate. However, these are exactly the areas that are exposed to the corrosive attack of the condensate.

A further beneficial feature of the present invention is that the sacrificial anode can be inspected and replaced, if necessary. This makes it possible to satisfy the demand for lifelong corrosion protection. This is not possible when galvanized sheet metal is used because the layers of zinc are thin and once damaged, cannot be reconditioned.

Beneficially, the sacrificial anode is a threaded bolt and is screwed into the pipe, or the housing, from the outside. This simplifies the inspection and the replacement of the sacrificial anode, if required.

In this context, it is recommended to incorporate a threaded passage into the pipe and the housing, respectively. Suitable methods are generally known therefor.

As an alternative, a threaded bushing can be inserted in the pipe and the housing, respectively.

If the threaded bushing is made of an insulating material, the sacrificial anode is electro-conductively connected with the pipe, or the housing, via a separate conductor. Such an external connection has various advantages.

One advantage is that a current-measuring instrument can be looped into the conductor. In this way, the efficiency of the sacrificial anode can be measured without the need to dismount it.

If the current-measuring instrument includes a light-emitting diode according to an embodiment of the invention, the operator of the car can check the function of the sacrificial anode themselves.

Furthermore, a direct current source can be looped into the separate conductor. With such a direct current source, the corrosion protection function can be further controlled.

According to a preferred embodiment of the invention, the inner side of the pipe or housing that is exposed to the condensate is provided with an electro-insulating anti-corrosion coating. The result thereof is that the sacrificial anode only releases ions when the corrosion-preventive coating is damaged. In this way, the usage of anode material is substantially reduced.

A suitable electro-insulating corrosion-preventive coating can be a coating containing aluminum.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
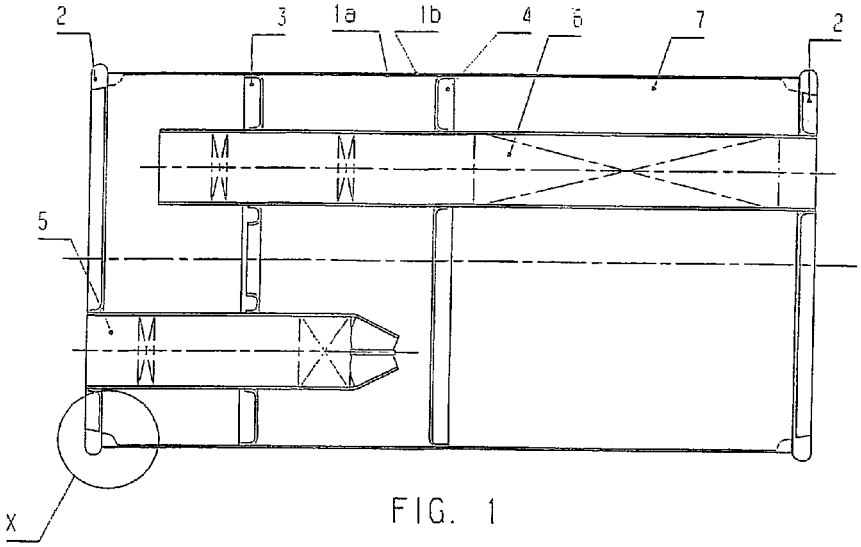
FIG. 1 is a longitudinal section of a muffler housing.

FIG. 1 shows a longitudinal section of an exhaust muffler. The housing thereof is comprised of two metal end plates 2, over which a housing shell 1 is wrapped. Inside the housing 1, 2, there are two partition walls 3, 4, thus forming a three-chamber muffler. An intake pipe 5 leads into the housing 1, 2, and a discharge pipe 6 emerges from the housing 1, 2.

In a muffler housing such as this, condensate collects at the lowest point, where it unfurls its damaging effects. This area is referenced in FIG. 1 with "X".

Figure 2:
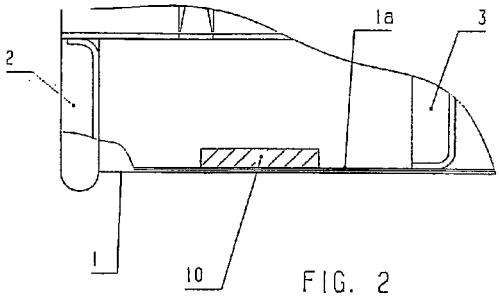
FIG. 2 is an enlarged illustration of section X in FIG. 1 with a first sacrificial anode.

FIG. 2 is an enlarged illustration of section "X" in FIG. 1. Located inside the housing 1, 2, is a sacrificial anode 10, which can be made of zinc and/or magnesium. As soon as condensate gathers in this area and starts to subject the housing shell 1 and the metal end plate 2 to its damaging effects, the sacrificial anode 10 releases zinc and/or magnesium ions into the condensate, which drift to the corrodible areas to protect them from corrosion. The corrosion-preventive function is thereby concentrated on the areas that are exposed to the condensate corrosion.

Figure 3:
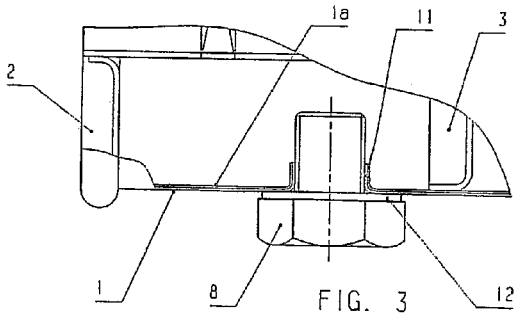
FIG. 3 illustrates section X in FIG. 1 with a second sacrificial anode.

FIG. 3 illustrates a further embodiment of the present invention, whereby a passage 11, which can be threaded, is integrated in the housing shell 1. A threaded bolt 8 made of zinc and/or magnesium is screwed into the threaded passage 11 to serve as a sacrificial anode. A sealing disk 12 prevents gasoline and fluid leaks. In this embodiment, the sacrificial anode 8 can be unscrewed, inspected, and re-inserted, or replaced by a new sacrificial anode without causing any damage. If this inspection and maintenance is done regularly, the corrosion protection inside the exhaust system can be maintained for life.

Figure 4:
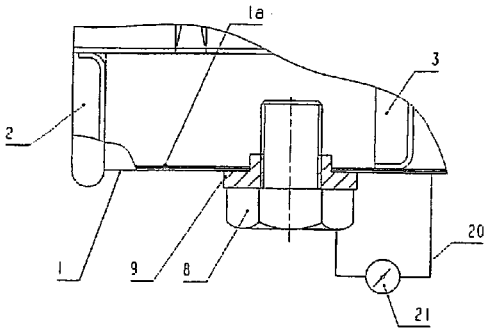
FIG. 4 illustrates section X in FIG. 1 with a third sacrificial anode.

In FIG. 4, a third embodiment is illustrated. In the housing shell 1, a threaded bushing 9 that is made of an insulating material is inserted. The sacrificial anode 8 is screwed into the bushing 9. The electrical connection from the sacrificial anode 8 to the housing 1, 2, is realized via an external conductor 20.

A measuring instrument 21 can be looped into this external conductor 20. This measuring instrument makes it possible for the maintenance personnel to determine the efficiency of the sacrificial anode 8 without having to dismount the sacrificial anode 8.

If a light-emitting diode is used for a measuring instrument 21, it can also remain permanently in the conductor 20. In this case, the operator of the motor vehicle can determine him or herself if the sacrificial anode is still functioning.

Instead of the measuring element 21, or in addition thereto, a direct current source can be looped into the conductor 20, with the aid of which the release of metal ions by the sacrificial anode can be controlled.

If the usage of anode material is to be reduced, the inner surface 1*a* of the housing 1, 2, is coated with an electro-insulating corrosion-preventive coating that is preferably based on aluminum. Suitable aluminized metals are commercially available.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An exhaust system comprising:

at least one pipe;

a housing substantially enclosing the at least one pipe, the housing facilitating flow of exhaust fumes of an internal combustion engine therethrough and being partially made of sheet metal; and a sacrificial anode that is made of zinc and/or magnesium and is provided in at least an area where condensate, which is formed from exhaust fumes, collects to inhibit corrosion of the sheet metal, wherein an interior side of the pipe or the housing, which is exposed to the condensate, is provided with an electro-insulating corrosion-preventive coating.

2. The exhaust system according to claim 1, wherein the sacrificial anode is a threaded bolt and is screwed into the pipe or the housing.

3. The exhaust system according to claim 1, wherein a threaded passage is provided in the pipe or the housing for receiving the threaded bolt.

4. The exhaust system according to claim 1, wherein the interior side of the pipe or the housing has an aluminum coating.

5. An exhaust system comprising:

at least one pipe;

a housing substantially enclosing the at least one pipe, the housing facilitating flow of exhaust fumes of an internal combustion engine therethrough and being partially made of sheet metal; and a sacrificial anode that is made of zinc and/or magnesium and is provided in at least an area where condensate, which is formed from exhaust fumes, collects to inhibit corrosion of the sheet metal, wherein the sacrificial anode is a threaded bolt and is screwed into the pipe or the housing, and wherein a threaded bushing is inserted in the pipe or the housing for receiving the threaded bolt.

6. The exhaust system according to claim 5, wherein the threaded bushing is made of an insulating material, and wherein the sacrificial anode is conductively connected with the pipe or the housing by a conductor.

7. The exhaust system according to claim 6, wherein a current-measuring instrument is connected with the conductor.

8. The exhaust system according to claim 7, wherein the current-measuring instrument includes a light-emitting diode.

9. The exhaust system according to claim 6, wherein a direct-current source is connected with the conductor.

* * * * *